US008024874B2

(12) United States Patent
McClanahan et al.

(10) Patent No.: US 8,024,874 B2
(45) Date of Patent: Sep. 27, 2011

(54) WEAR ASSEMBLY FOR EXCAVATING MACHINES

(75) Inventors: Robert McClanahan, Milwaukie, OR (US); Adam Stitzel, Manlius, NY (US)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 11/511,634

(22) Filed: Aug. 28, 2006

(65) Prior Publication Data

US 2007/0044349 A1 Mar. 1, 2007

Related U.S. Application Data

(60) Provisional application No. 60/712,915, filed on Aug. 30, 2005, provisional application No. 60/758,179, filed on Jan. 10, 2006.

(51) Int. Cl.
*E02F 9/28* (2006.01)

(52) U.S. Cl. ..... 37/452; 37/446

(58) Field of Classification Search ..... 37/446, 37/450, 452–456
See application file for complete search history.

(56) References Cited

U.S. PATENT DOCUMENTS

| | | | | |
|---|---|---|---|---|
| 1,419,047 | A | | 6/1922 | Hanks et al. |
| 2,311,463 | A | * | 2/1943 | Page ..... 37/455 |
| 2,987,838 | A | * | 6/1961 | Stratton ..... 37/459 |
| 3,762,079 | A | | 10/1973 | Lukavich et al. |
| 3,851,413 | A | | 12/1974 | Lukavich |
| 3,947,982 | A | | 4/1976 | Mantovani |
| 3,982,339 | A | | 9/1976 | Nilsson |
| 4,136,469 | A | * | 1/1979 | Zepf ..... 37/452 |
| 4,625,437 | A | | 12/1986 | Curtis et al. |
| 4,748,754 | A | | 6/1988 | Schwappach |
| 5,088,214 | A | * | 2/1992 | Jones ..... 37/450 |
| 5,172,501 | A | | 12/1992 | Pippins |
| 5,177,886 | A | | 1/1993 | Klett |
| 5,325,615 | A | | 7/1994 | Hutchins et al. |
| 5,412,885 | A | | 5/1995 | Comellus |
| 5,526,592 | A | | 6/1996 | Bierwith |
| 5,553,409 | A | | 9/1996 | Irving |
| 5,634,285 | A | | 6/1997 | Renski |
| 5,709,043 | A | | 1/1998 | Jones et al. |
| 5,713,145 | A | | 2/1998 | Ruvang |
| 5,806,216 | A | | 9/1998 | Renski |
| 5,852,888 | A | | 12/1998 | Comellus |
| 5,956,874 | A | | 9/1999 | Ianello et al. |
| 5,987,787 | A | | 11/1999 | Mack |
| 6,145,224 | A | * | 11/2000 | Stickling ..... 37/458 |

(Continued)

OTHER PUBLICATIONS

"CRODON® Wear Plate Product Groups." chromcorp.com/crodon/products.cfm. 1996. Chromium Corporation Product Info. Oct. 11, 2003. <http://web.archive.org/web/*/http://www.chromcorp.com/crodon/products.cfm>.*

(Continued)

*Primary Examiner* — Thomas Will
*Assistant Examiner* — Mai Nguyen
(74) *Attorney, Agent, or Firm* — Steven P. Schad

(57) ABSTRACT

A wear member that includes a pair of legs defining a slot straddles the digging edge of a piece of excavating equipment. In one construction, the slot is formed at its front end with a pair of inclined surfaces and a laterally extending ridge that is fit within a complementary channel on the digging edge. A lock is received within an opening in the wear member to releasably secure the wear member to the digging edge.

21 Claims, 9 Drawing Sheets

U.S. PATENT DOCUMENTS

| | | | | |
|---|---|---|---|---|
| 6,151,812 | A | 11/2000 | Bierwith | |
| 6,230,424 | B1 * | 5/2001 | Renski et al. | 37/446 |
| 6,564,482 | B2 | 5/2003 | Ruvang | |
| 6,735,890 | B2 | 5/2004 | Carpenter et al. | |
| 6,848,203 | B2 | 2/2005 | Hohmann et al. | |
| 2002/0078607 | A1 * | 6/2002 | Perry et al. | 37/446 |
| 2004/0083630 | A1 * | 5/2004 | Ruvang | 37/456 |

OTHER PUBLICATIONS

"CRODON General Specifications." chromcorp.com/specs.cfm. 1996. Chromium Corporation Technical Specifications. Mar. 17, 2006. <http://web.archive.org/web/*/http://www.chromcorp.com/crodon/specs.cfm>.*

Berkeley Forge—TLC Dipper Lip and Hardware System for Electric Shovels [Bulletin No. 2003-SC, Berkeley, CA].

* cited by examiner

WEAR ASSEMBLY FOR EXCAVATING MACHINES

The present application is co-pending of U.S. provisional application Ser. No. 60/712,915, filed Aug. 30, 2005 and of co-pending U.S. provisional application Ser. No. 60/758,179, filed Jan. 10, 2006.

FIELD OF THE INVENTION

The present invention pertains to a wear assembly for use along the digging edge of an excavating machine.

BACKGROUND OF THE INVENTION

Excavating equipment of all kinds and sizes include various wear parts to protect the front digging edge from damage and wear. As a result, the wear parts are commonly subjected to highly abrasive materials and used under arduous conditions. To withstand the rigors of digging, the wear parts must be securely held to the excavating equipment to prevent their loss during use. Nevertheless, due to the harsh environment, the parts frequently wear out and need replacement.

A myriad of ways for attaching the wear parts have been developed with varying degrees of success in securely holding the parts during digging and facilitating easy replacement when the part is worn. For example, wear parts are often attached to the digging edge by welding to prevent loss during use. While welding securely holds the parts to the edge, it makes replacement difficult. Buckets and other digging equipment provided with weld-on wear parts are usually taken out of service for replacement in a shop. Such action typically results in the bucket or other digging equipment being out of service for an extended period of time.

To avoid the difficulties posed by welded parts, many wear parts are mechanically attached to the digging edge. For example, wear parts may be secured by Whisler-style attachments, bolting, etc. While such means facilitate replacement in the field, they also require the formation of holes in the digging edge, thus tending to weaken the equipment. Moreover, some mechanical attachments are susceptible to undesirable loosening.

U.S. Pat. No. 5,088,214 discloses a mechanically attached wear member that relies upon a boss instead of holes in the lip. Nevertheless, these parts can be difficult to manufacture and at times experience high levels of stress in the legs under certain loading.

SUMMARY OF THE INVENTION

The present invention pertains to a wear assembly to protect the digging edge of excavating equipment, such as the lip of a bucket. The wear assembly includes a wear member mounted to a support structure of the equipment, and lock to hold the wear member to the support structure.

In accordance with one aspect of the invention, the wear member includes an inwardly projecting support that bears against the base to provide enhanced resistance to back drag and certain vertical loads. The support and base include complementary surfaces that are inclined relative to the central plane of the lip, with the support being rearward of this surface of the base.

In one construction, the base includes inclined upper and lower surfaces adapted to receive and mate with inner surfaces of the wear part. The wear part further includes a pair of spaced apart legs that straddle the digging edge rearward of the boss. With the upper and lower surfaces inclined downward, the support projects upward into the space defined between the legs of the wear part. The support then bears against the lower inclined surface of the base during upward vertical loading of the wear member, thus, decreasing the resistance and concomitant stress generated in the upper leg. Accordingly, the leg can have a reduced construction, which requires less steel in its manufacture, reduces the amount of material discarded at the time of replacement, has a smaller risk of failure, and facilitates easier removal.

In another aspect of the invention, a wear member for excavating equipment includes a rearwardly-opening cavity for receiving a support structure. The cavity has upper and lower surfaces at its front end that are inclined in the same general direction relative to a central plane of the support structure to provide enhanced support.

Another aspect of the invention pertains to a wear member for protecting a digging edge of excavating equipment. The wear member includes a pair of legs that straddle the digging edge, and a transverse ridge on one of the legs to be received into a complementary channel in the digging edge. The ridge provides enhanced support during use and reduces stress in the opposite leg.

Another aspect of the invention pertains to a wear member that includes a pair of legs defining a slot for receiving a digging edge of excavating equipment. The front end the slot dips downward and is closed by an abutting surface. In this way, the wear member has better support and experiences less stress.

In another aspect of the invention, a support structure in the form of an insert, formed of a harder material than the digging edge, is used to replace the portion of the edge adapted to support the wear member. In this way, the base is able to better protect the lip from wear. In one construction, the base is fixed within a recess formed in the front edge of the digging equipment that surrounds the base on three sides. To enhance its attachment, the rear wall of the base preferably has a generally V-shaped configuration.

In another aspect of the invention, the wear part includes a leg that at least partially extends over a face of the digging equipment. On account of the mechanical attachment, the wear part will tend to shift under the heavy loading typically associated with digging operations. To lessen the wear caused by this shifting, a wear plate is secured between the leg and the equipment.

In accordance with one other aspect of the invention, the base and wear part are formed with complementary curved bearing faces. The base includes a forward-facing convex bearing surface, and the wear part a corresponding rearward-facing concave bearing surface. The bearing faces are preferably curved about two generally perpendicular axes such that the concave bearing face has generally shallow bowl-like configuration. The corresponding convex and concave surfaces provide better support for the wear part under loading at angles to the longitudinal axis of the assembly.

In a preferred construction of the present invention, the wear assembly provides high reliability in operation. The system stably supports the wear member in a reduced stress environment that resists breakage under heavy loading and provides an extended usable life. It is easy to manufacture, requires reduced maintenance, and provides an easy replacement procedure. The inventive system reduces wear on the underlying digging edge of the equipment and minimizes the amount of material to be discarded when replacement is required.

The present inventive system is further able to withstand loads and provide suitable protection with a smaller part as compared to many conventional mechanically attached parts.

It enables mechanical attachment of the wear part without the formation of holes in the equipment or reliance on adjacent adapters. Additionally, it does not suffer loss due to unintended loosening of fastening means.

DETAILED DESCRIPTION OF THE PREFERRED EMBODIMENTS

The present invention pertains to a wear assembly for protecting a digging edge of an excavating machine such as the lip of an excavating bucket. While the assembly is particularly suited for securing a shroud to a lip, the inventive concepts can be used to secure other wear members (e.g., adapters, points, wings and the like) to bucket lips or other excavating equipment. For ease of discussion, this application describes the inventive assembly in terms of mounting a shroud to a bucket.

Figure 1:
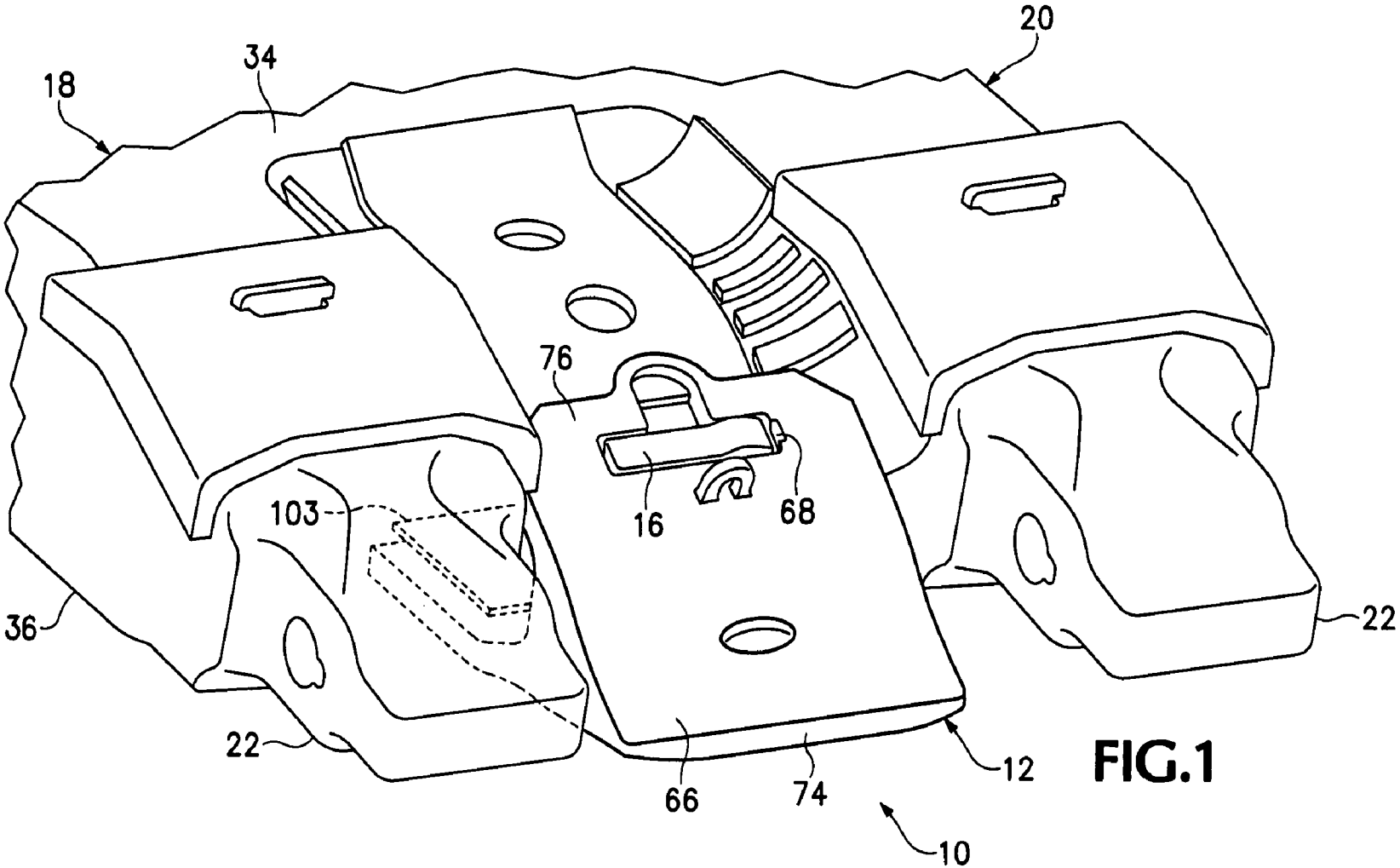
FIG. 1 is a perspective view of a wear assembly in accordance with the present invention mounted on a lip of a bucket.

A wear assembly 10 in accordance with one embodiment of the present invention includes a wear member 12 in the form of a shroud, a base or support structure 14, and a lock 16 (FIGS. 1-7). A shroud is a wear member that fits over the front edge 17 of an excavating bucket 18, between the excavating teeth, to protect the bucket lip 20 and direct the earthen material into the bucket. FIG. 1 illustrates one example of a lip 20 that includes forwardly projecting noses 22 for supporting points (not shown). The noses and points collectively define the excavating teeth that penetrate and break up the ground ahead of the bucket. While noses 22 are shown as being a cast part of the lip, they could be attached as adapters by welding or mechanical attachment. In any event, shroud 12 is placed over the front edge of lip 20 between noses 22.

Figure 7:
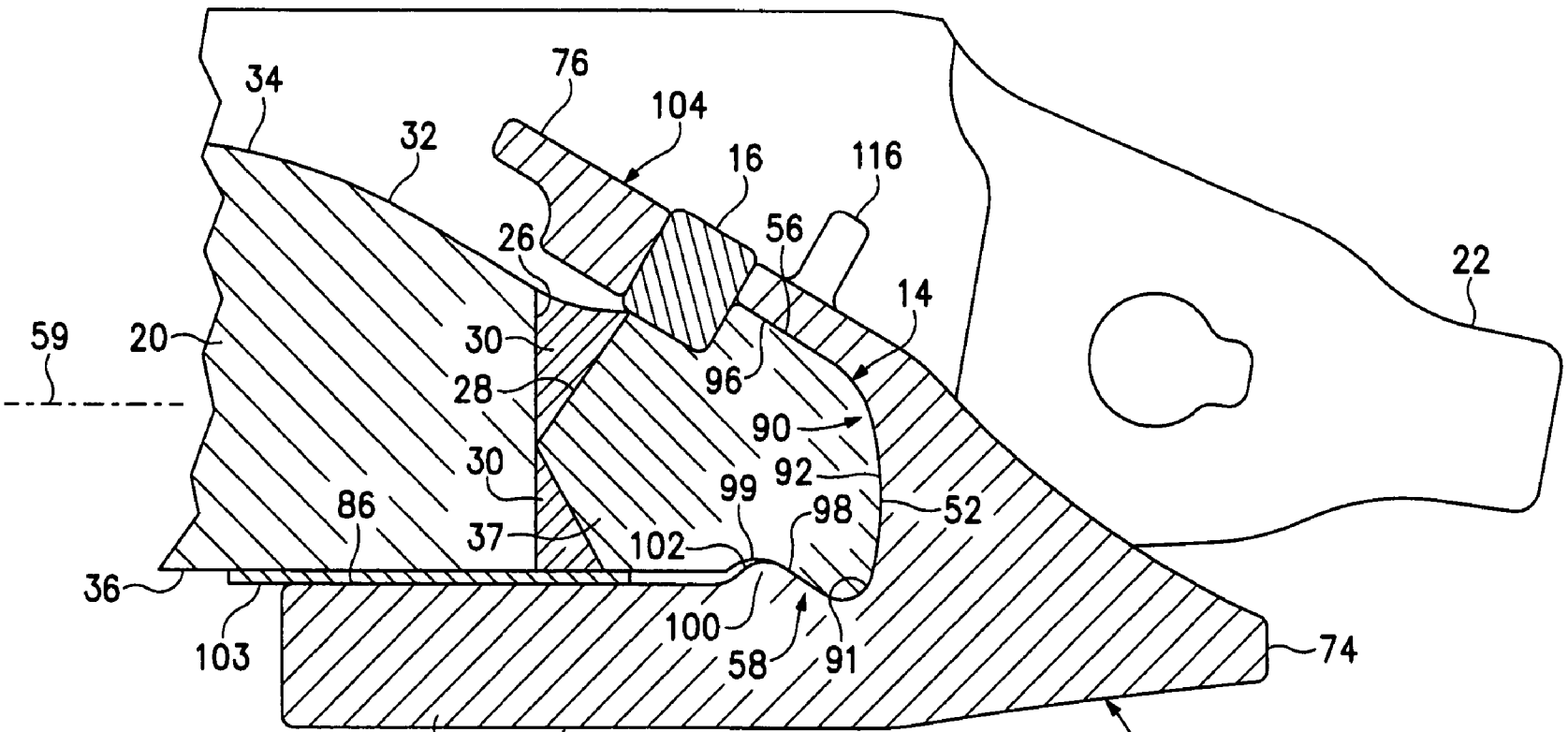
FIG. 7 is a cross-sectional view taken along line 7-7 in FIG. 3.
Figure 8:
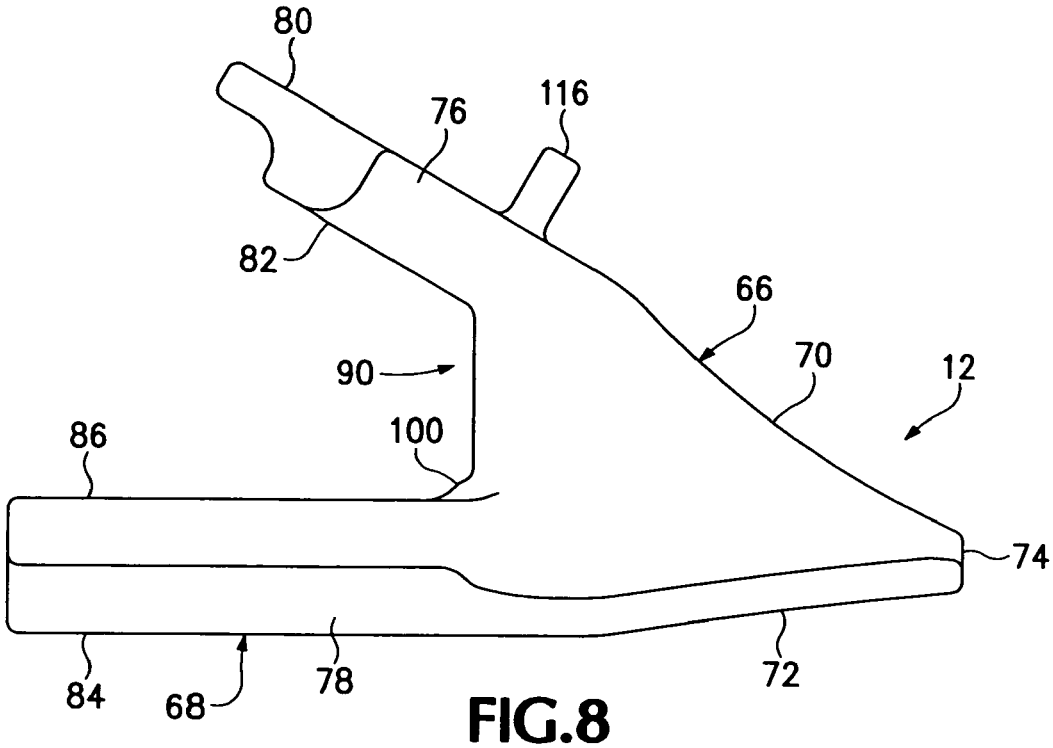
FIG. 8 is a side view of the wear member.
Figure 9:
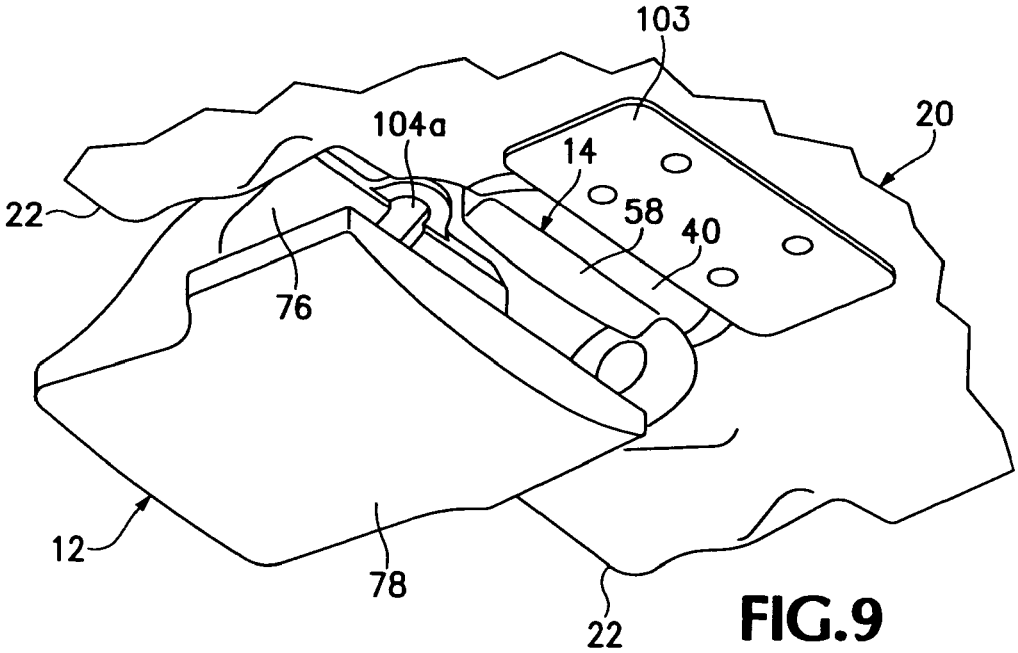
FIG. 9 is an exploded, bottom perspective view of the wear assembly.
Figure 11:
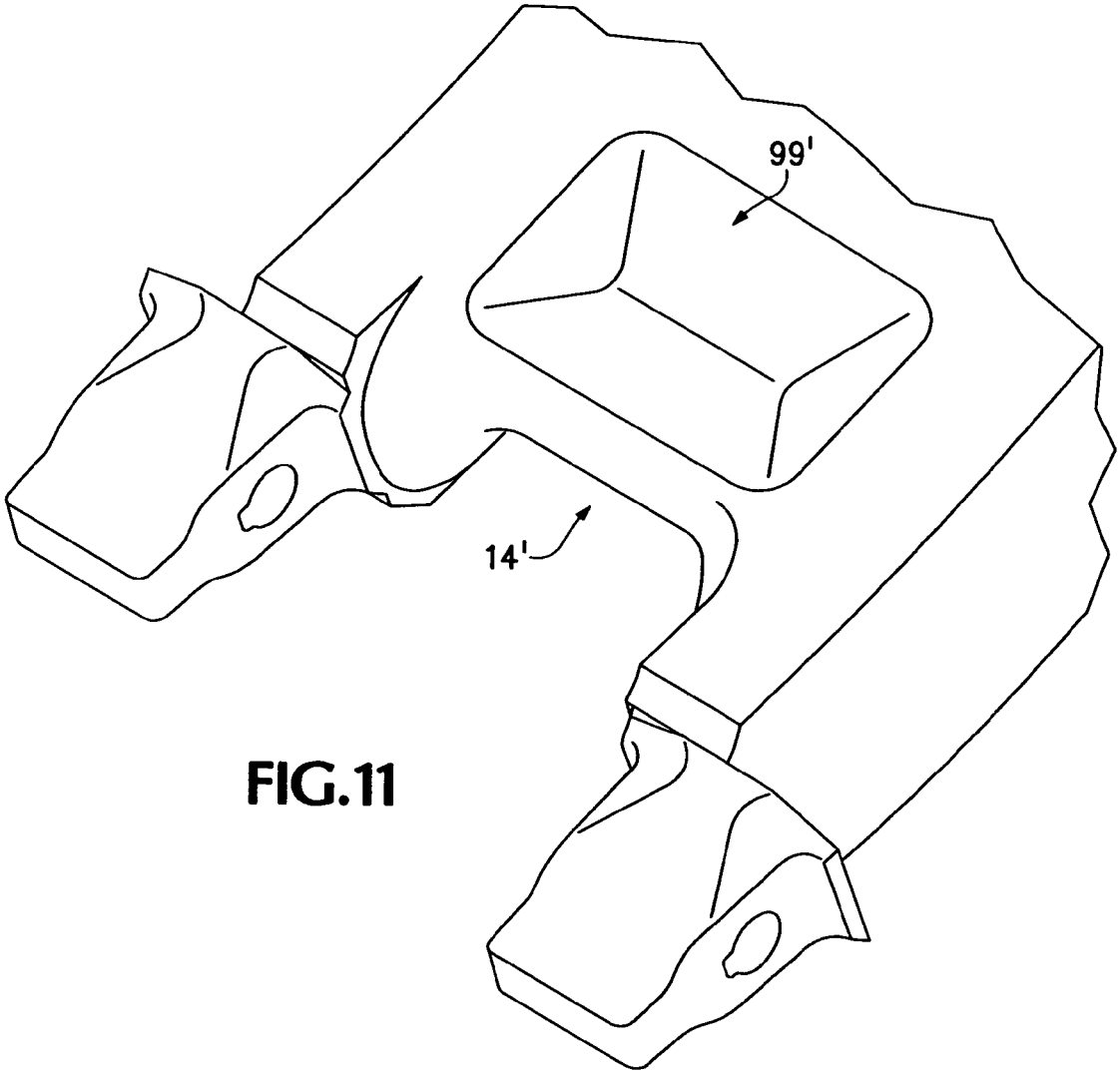
FIG. 11 is bottom perspective view of a portion of a lip of an alternative construction.
Figure 12:
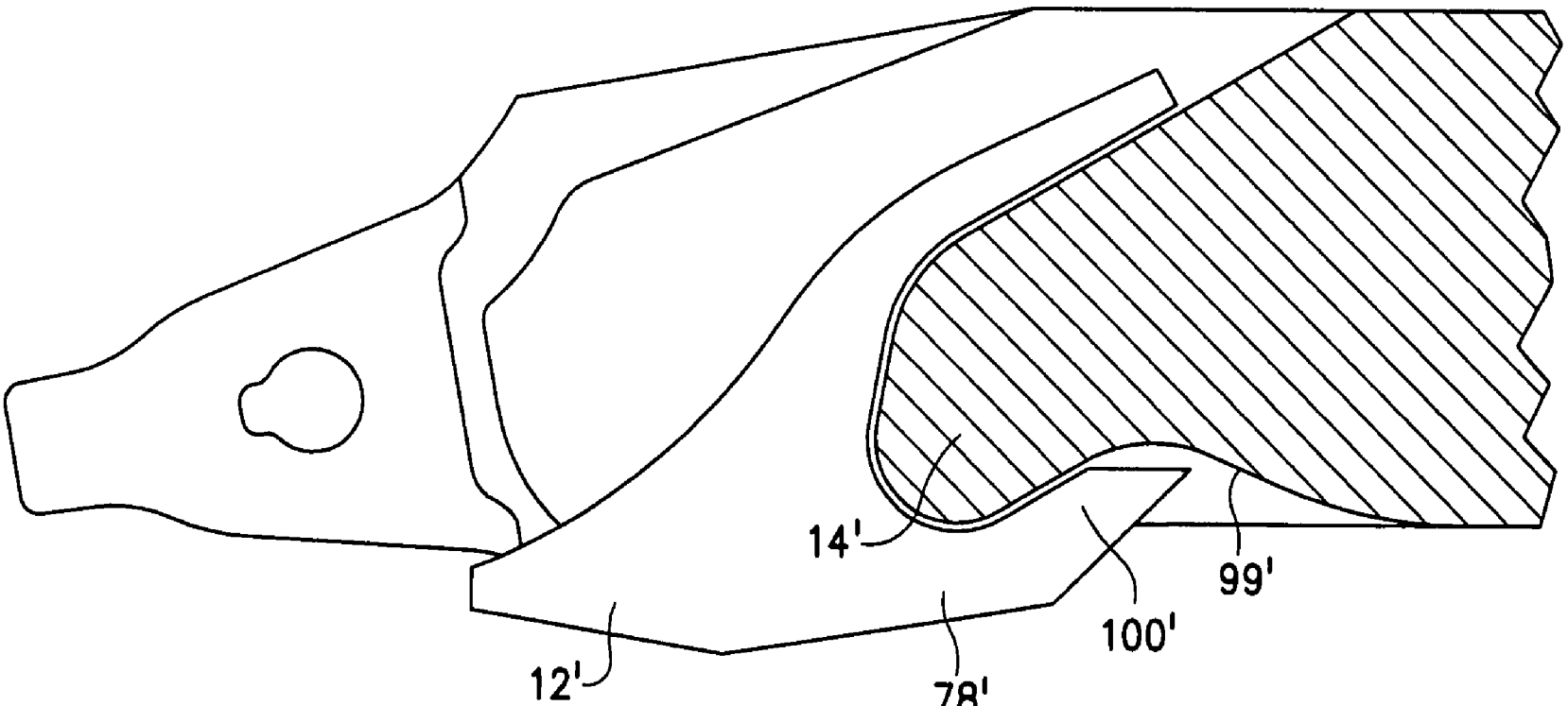
FIG. 12 is a cross-sectional view taken along line 12-12 in FIG. 3.

Lip 20 includes a base or support structure 14, which is either formed as an insert fixed to lip 20 for supporting the shroud 12 (FIGS. 4-7) or as a fixed portion of the lip that supports the shroud (FIGS. 11 and 12). In one construction (FIGS. 4-7), base 14 is welded within a recess 24 in lip 20, although it could be secured by other means. The recess can be formed as a configuration of a cast lip or by being cut into the lip. Recess 24 is defined by a generally U-shaped supporting wall 26 having a rear portion 26*a* and two side portions 26*b*. Base 14 includes a complementary mounting wall 28 that includes a rear section 28*a* that opposes rear portion 26*a*, and two side sections 28*b* that oppose side portions 26*b*. A weld 30 is used to hold mounting wall 28 to supporting wall 26 along these three sections of the base for a secure attachment. As seen in FIG. 7, mounting wall 28 preferably has a V-shaped, convex configuration to facilitate effective welding, i.e., a weld 30 is applied along upper and lower faces 28*a*, 28*b* to hold the base in place. Alternatively, the supporting surface could be formed with a V-shaped configuration, or different shapes entirely could be used for both the mounting and supporting surfaces 26, 28. In any event, recess 24 preferably surrounds base 14 on three sides to securely hold the base in place during digging.

In this construction (FIGS. 4-7), base 14 is preferably cast as a one-piece member with two portions, i.e., a rear portion 37 and a front portion 46, though other constructions could be used. The rear portion defines a mounting structure that defines mounting surface 28. The front portion defines a boss that projects forward and cooperates with the wear member to provide a stable and secure attachment. The base is preferably composed of a harder material than the lip to better resist wearing caused by its engagement with wear part 12. Nevertheless, the lip is not necessarily softer than the base. While the lip is commonly made to emphasize toughness, which can lead to it being softer, the lip can be of equal or greater hardness as compared to the base. It is in any event preferable for the base to be formed of a hard material in order to resist wearing.

Figure 4:
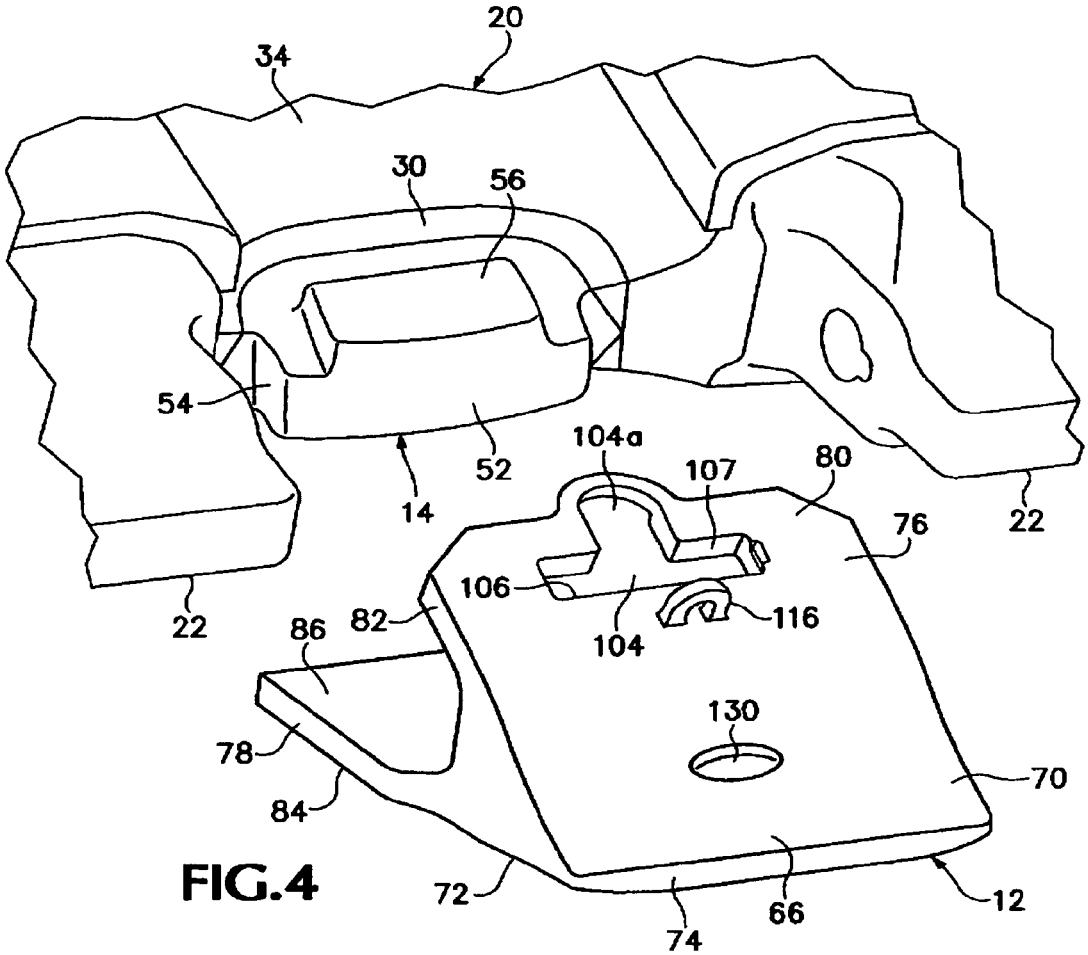
FIG. 4 is an exploded perspective view of the wear assembly.
Figure 5:
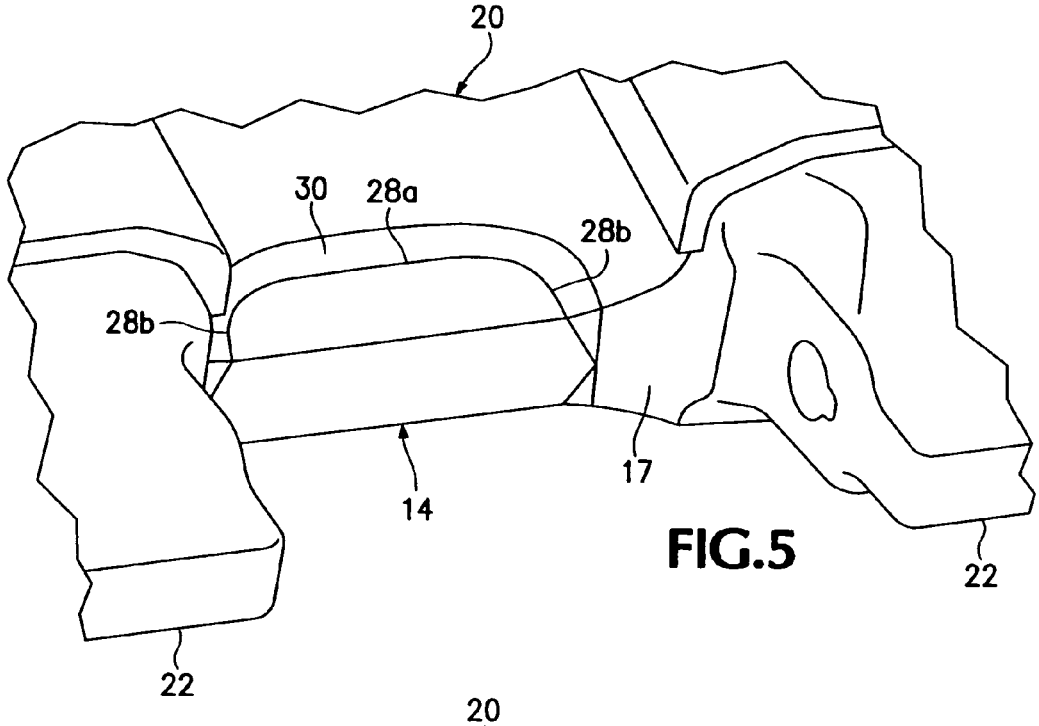
FIG. 5 is a perspective view of the lip with the front portion of the base omitted.
Figure 6:
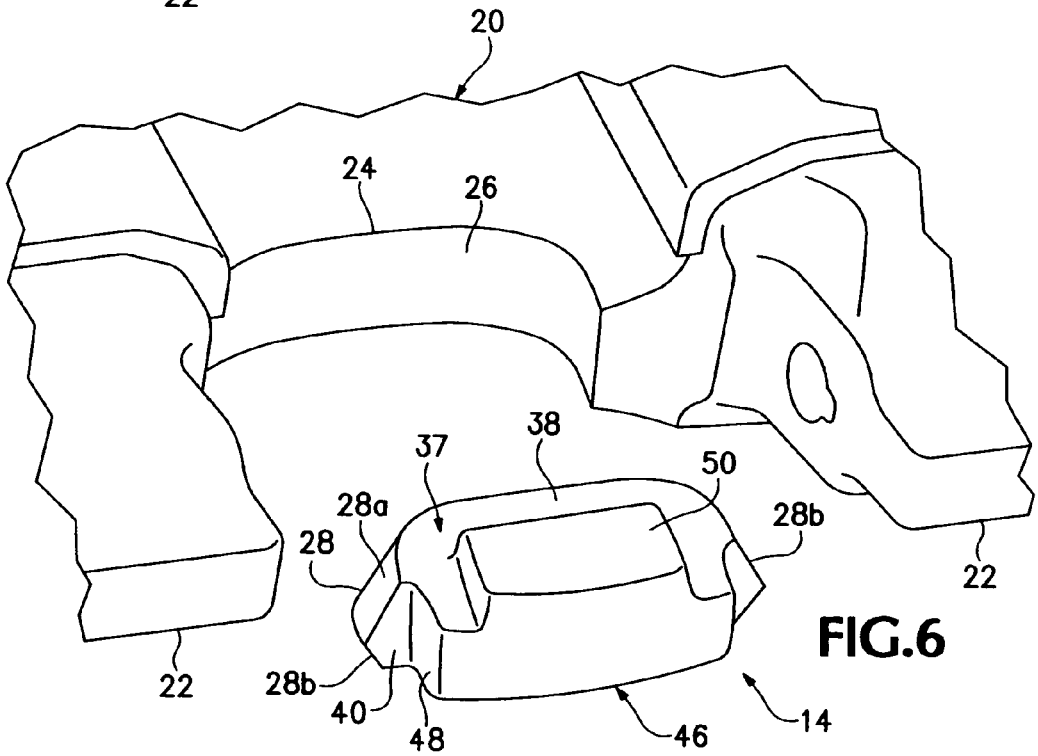
FIG. 6 is an exploded perspective view of the base relative to the lip.

In the illustrated example (FIGS. 1 and 7), lip 20 includes a ramp 32 as part of the inside face 34 of the bucket. Ramp 32 converges toward outside wall 36 to define the narrow front edge 17. Rear portion 37 of base 14 includes an upper wall 38 generally associated with ramp 32, and a lower wall 40 that is generally co-extensive with outside wall 36. A lateral channel or recess 99 extends across base 14 for receiving a support 100 of wear member 12 as discussed below. As seen in FIG. 4, rear portion 37 is received entirely within recess 24. Nevertheless, other arrangements could be used. In addition, the inventive wear assembly could be used in connection with lips having different constructions.

In one embodiment, front portion 46 includes a forwardly projecting body 48 and an upstanding boss 50. In a preferred construction, boss 50 extends rearward partially over rear portion 37 (FIGS. 4-7). Front portion 46 includes a front surface 52, side surfaces 54, a top surface 56, and a bottom surface 58. Top and bottom surfaces 56, 58 are generally parallel to each other and inclined upward as they extend rearward. For example, surfaces 56, 58 are inclined at about the same angle (e.g., about 30° to the center plane 59 of lip 20). In one construction, surface 56 is inclined at an angle of about 33° to plane 59 whereas surface 58 is inclined at an angle of about 30°. Nevertheless, surfaces 56, 58 could be the same or varied relative to each other by more than three degrees, and in some uses much more than three degrees. Additionally, surfaces 56, 58, could be inclined at angles larger or smaller than 30°. While top and bottom surfaces 56, 58 are preferably generally planar, they could have some lateral or longitudinal curvature in a convex or concave direction.

Front surface 52 is preferably formed with a convex curved shape which curves about two generally perpendicular axes. In particular, front surface 52 is curved generally about a vertical axis so that it curves rearward as it approaches each respective side surface 54. Preferably, front surface 52 is also curved generally about a horizontal axis so that it also curves rearward as it approaches each of the top and bottom surfaces 56, 58. In one preferred construction, the curvatures resemble arcs of ellipses. Nevertheless, front surface 52 could be defined as a spherical segment, by curvatures that follow different paths, or by curvatures that vary. Front surface 52 could also be formed with a generally planar configuration or curved about a single axis or axes extending in only one direction.

When the base 14' is formed as a portion of the lip (i.e., without a separate insert), the base has the same boss and channel features as when the base is a welded insert in the lip. For example, the lip and base configuration shown in FIG. 7 could be formed as a single, one piece portion integral with the lip. One example of such a lip is shown in FIGS. 11 and 12. In FIG. 12, the rear wall of the boss that engages the lock is received within a cavity in the shroud 12' and not seen.

Shroud 12 includes a front wearable portion 66 and a rear mounting portion 68 (FIGS. 1-4 and 7-8). Front portion 66 is illustrated as having top and bottom converging walls 70, 72 that converge to a narrow front edge 74. Mounting portion 68 includes a pair of spaced apart legs 76, 78 that are adapted to define a slot or cavity 90. The slot is generally open along its sides so that legs 76, 78 straddle the wider digging edge of lip 20. Top leg 76 includes an outer wear surface 80 and an inner surface 82 overlying base 14 and ramp 32. Likewise, bottom leg 78 includes an outer wear surface 84 and an inner surface 86 overlying base 14 and outside face 36 of lip 20. In the illustrated embodiment, legs 76, 78 diverge in a rearward direction to collectively have a generally V-shaped configuration to correspond to the shape of the lip. The use of diverging legs also facilitates easier removal from the lip. Nevertheless, the shape of the legs could be varied to accommodate different lip shapes or different uses. Also, while top leg 76 could extend rearward of ramp 32, it preferably sets only on the ramp for reduced material in its manufacturing, reduced waste at the time of its replacement, less risk of failure, and easier installation and removal from the lip.

The front end 91 of cavity 90 is defined at the intersection of legs 76, 78 to receive the front portion 46 of base 14. This front end is defined by a front abutting surface 92 adapted to abut front surface 52, side walls along side surfaces 54, a top face 96 extending over top surface 56, and a bottom face 98 along bottom surface 58. The front end of the cavity is adapted to matingly receive front portion 46 of base 14. However, since the base and shroud are preferably cast steel parts, it would be common for some looseness to exist between the components even when new.

Front face 92 is preferably curved about two generally perpendicular axes to abut against front surface 52. This abutment of front face 92 against front surface 52 is the primary means for resisting the substantial axial loads expected during use. As can be appreciated, the digging operation causes loads to be applied against the shroud in many different directions. Hence, such loads are typically applied with vertical and/or lateral components along with the axial component. The curvature of abutting surfaces 52, 92 enables the shroud to rock about the base as the loads are applied to increase stability of the shroud and better resist the loads. This interaction of abutting surfaces 52, 92 is essentially the same as described in U.S. Pat. No. 6,729,052, which is incorporated herein by reference.

Shroud 12 is installed onto base 14 by sliding base 14 into cavity 90 (FIGS. 4 and 7). As best seen in FIG. 7, the shroud is slid upward on an inclined path defined by top and bottom faces 96, 98 of cavity 90 sliding along top and bottom surfaces 56, 58 of boss 46 until front face 92 abuts front surface 52. Bottom face 98 engages along bottom surface 58 so that a support 100 is formed to resist back drag forces and forces with upwardly-directed vertical components. Support 100 preferably resists upwardly-directed loads in combination with other supporting surfaces such as top leg 76 of shroud 12. Shroud 12' (FIG. 12) is shown with a shortened lower leg 78' as an alternative to the longer leg 78 (FIG. 7). In this arrangement, support 100' fits within recess 99' and forms the end of lower leg 78'. Nevertheless, shroud 12 could also be used in connection with base 14'.

In the preferred construction, base 14 or 14' provides a laterally extending channel or recess 99 or 99' to enable support 100 to extend upward a greater distance. This lengthened extension provides a greater surface area for contact between the base 14 and support 100, and raises the support farther above the applied upwardly directed load to front edge 74 for enhanced resistance. Support 100 extends along all or most of the width of bottom surface 58 so as to project into recess 99. This formation of support 100 defines a lateral ridge along cavity 90 between front portion 66 and bottom leg 78. Nevertheless, support 100 could be formed as a non-elongated projection or as a series of non-elongated projections received in complementary recesses. In a preferred construction, support 100 has a generally symmetrical configuration with an inclined engagement surface 98 and an oppositely inclined bracing surface 102 for enhanced support and less localized stress in the part. Also, the positioning of a projecting support 100 adjacent the crux of the intersection of legs 76, 78 provides a stronger assembly.

As noted, the engagement of support 100 against base 14 provides enhanced resistance to upwardly directed loads on the wear member, which are expected in most digging operations (FIG. 7). More specifically, an upwardly directed load L applied to the front edge 74 of shroud 10 tends to cause the shroud to "rotate" about base 14; i.e., the front edge 74 is pushed upward and the top leg 76 is pushed downward against the lip. If support 100 is not provided against the downwardly inclined bottom surface 58, the rearwardly extended top leg 76 is forced to provide greater resistance in a cantilever form to prevent the shroud from rolling off of the lip. In high loading of the shroud, this can place great stress on the leg, which in the past has at times led to breakage of the wear member. The provision of support 100 also enables top leg 76 to have a short extension and lie only against the ramp to lessen the needed steel and ease manufacturing of the part. Front surface 98 of support 100 is inclined to be generally transverse to many of the loads applied to the front of the shroud and thereby provide enhanced resistance to the rolling of the shroud. In the preferred construction, front surface 98 has generally the same inclination as bottom surface 58. As discussed above, the inclination can vary and be chosen depending on the size and anticipated use of the wear part in order to maximize support from the loads expected for the particular operation.

Downwardly-directed loads on shroud 12 are resisted primarily by top face 96 bearing against base 14 and bottom leg 78 bearing against lip 20. Top face 96 and the corresponding top surface 56 are each inclined to provide a surface that is transverse to many of the loads having downwardly directed force components and thereby provide enhanced resistance. Moreover, the securing of the top leg with the lock tends to resist rocking of the shroud and thus imposes less stress on the bottom leg. Nevertheless, since there is no support provided at the top of cavity 90, bottom leg 78 preferably extends across lip 20 a greater distance than leg 76. Also, to reduce wearing of the outside face 36, a wear plate 103 is preferably welded to lip 20 between leg 78 and outside face 36. Alternatively, top and bottom surfaces 56, 58 could be inclined in the opposite directions if desired for certain kinds of digging operations.

Side faces 94 are placed alongside side surfaces 54 for proper positioning of shroud 10 on lip 20, and to resist side loading applied to the shroud. Since base 14 is preferably formed of a harder material than the lip, it is better able to resist side loading without suffering undue wear as compared to a conventional front cast tab on the lip. The base also projects forward a greater distance than conventional tabs.

Top leg 76 extends rearward of boss 46 and is formed with an opening 104 to receive lock 16. Opening 104 extends rearward of boss 46 to receive the lock between the rear face 107 of opening 104 and rear wall 106 of base 14. In the preferred construction, rear wall 106 is formed at the end of arm 50. Alternatively, arm 50 could be omitted and rear wall 106 formed at the rear end of body 48. In either case, rear wall 106 is preferably positioned forward of the rear portion 28*a* of mounting wall 28 so that the lock sets on upper wall 38 rather than directly on lip 20. Opening 104 preferably has a rectangular shape, though other configurations could be used.

Figure 2:
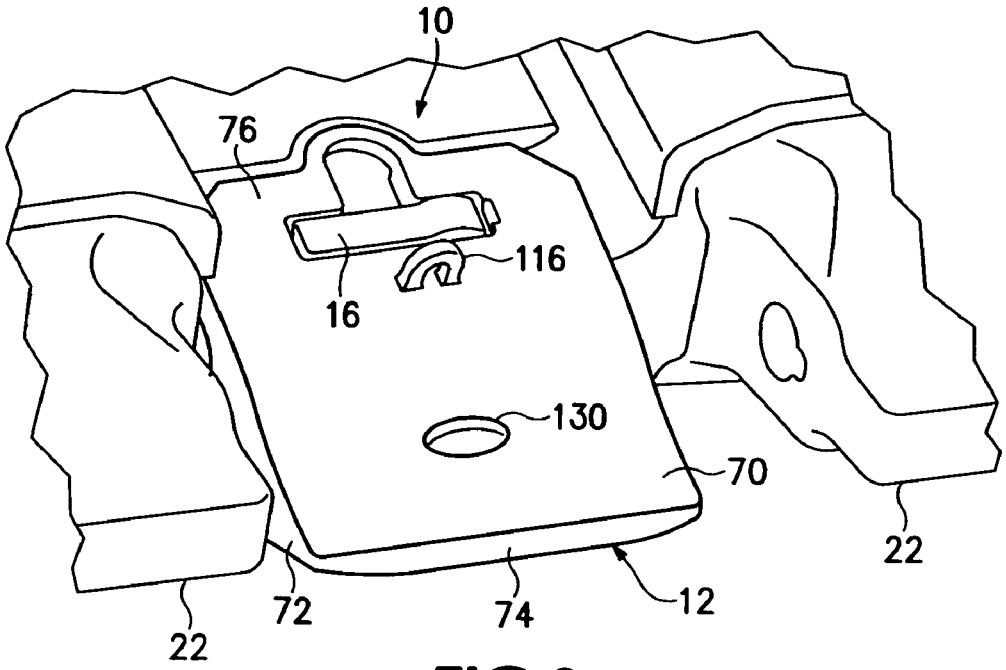
FIG. 2 is a perspective view of the wear assembly.
Figure 3:
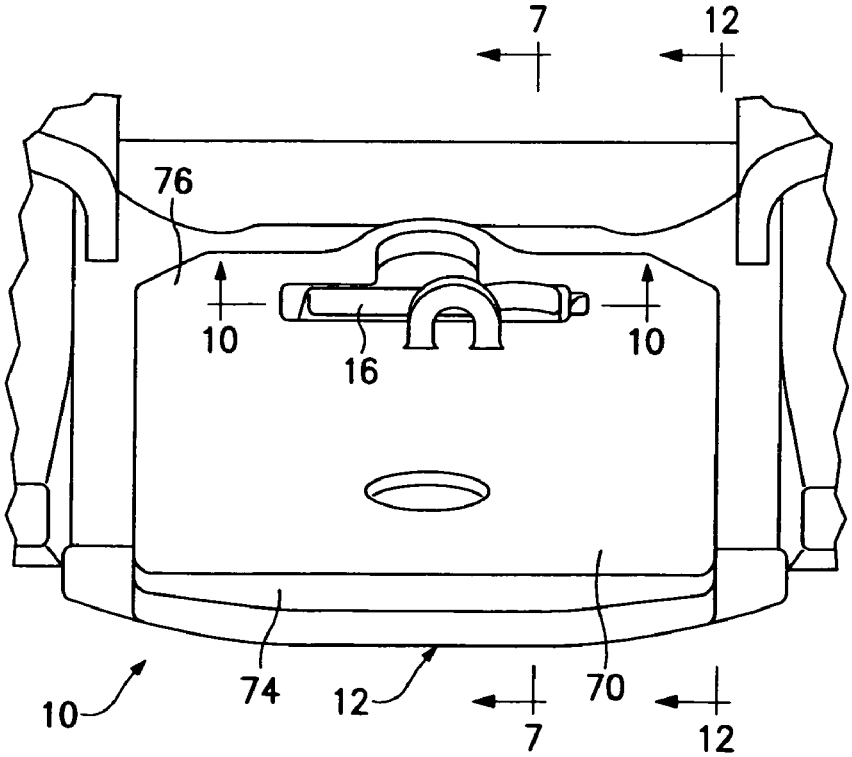
FIG. 3 is a front view of the wear assembly.
Figure 10:
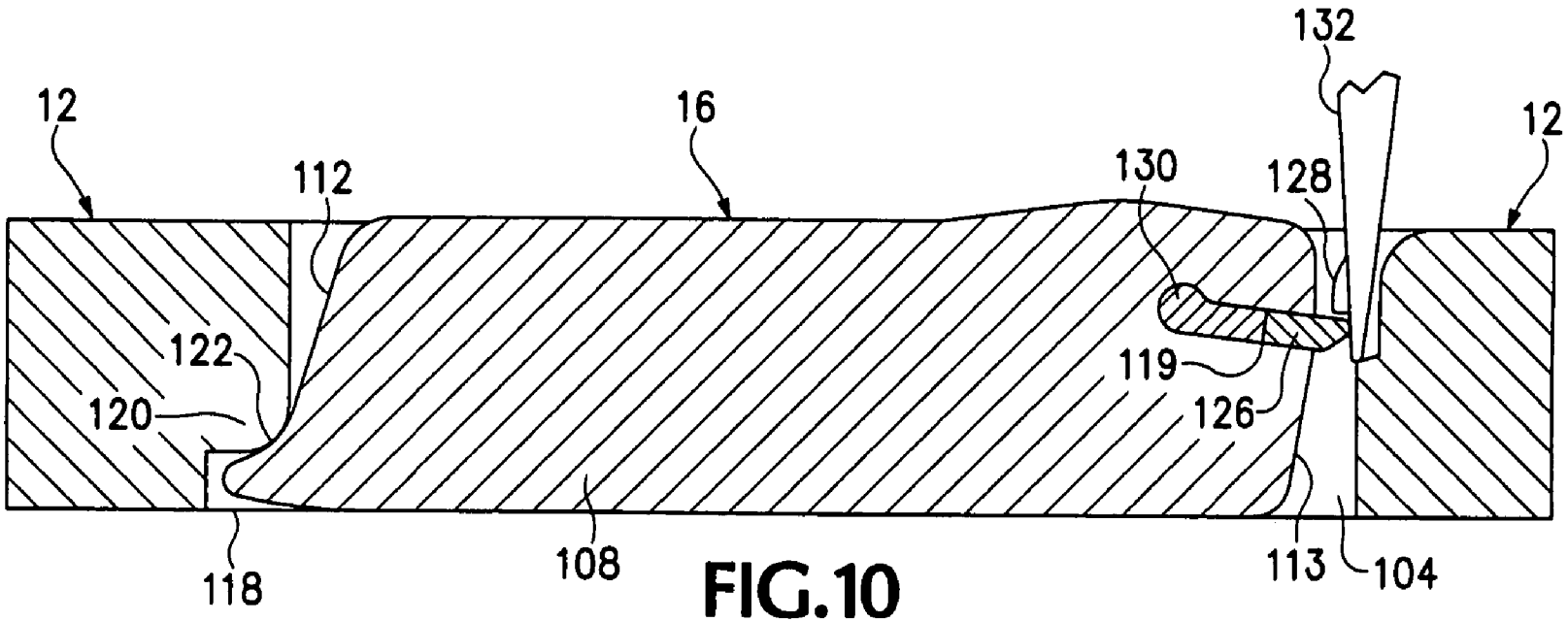
FIG. 10 is a cross sectional view of the wear assembly taken along line 10-10 in FIG. 3, with a tool in place to facilitate removal of the lock.

Lock 16 includes a body 108 that preferably matches the shape of opening 104 and thus in the illustrated embodiment has a block-like shape provided with a front wall 110, a rear wall 111 and sidewalls 112-113 (FIGS. 1-3). When installed in opening 104, front wall 110 opposes rear wall 106 of boss 46 and rear wall 111 opposes rear face 107 of opening 104. The engagement of the lock with the shroud and base prevents the shroud from sliding forwardly from the lip. Similar to the lock disclosed in U.S. Pat. No. 5,088,214, incorporated herein by reference, body 108 includes a tang 118 extending from sidewall 112 and a latch 119 extending from sidewall 113 (FIG. 10). Tang 118 fits under a ledge 120 defined within opening 104 and forms a fulcrum 122 about which lock 16 rotates into opening 104. Latch 119 is preferably formed on a side opposite tang 118 to releasably hold the lock in opening 104, although latch 119 could be formed on other surfaces as well. Latch 119 has a steel tab 126 to fit under a keeper 128 defined in opening 104, and a resilient member 130 to enable the tab 126 to be retracted to release the lock. Resilient member 130 is preferably composed of rubber or other elastomer. A pry tool 132 can be used to release latch 119 and remove lock 16 from opening 104. Alternatively, the latch could be a fixed formation on sidewall 112 with a resilient member formed on sidewall 113 to permit release of the latch from the keeper. Lock 16 could also include a take-up element such as disclosed in U.S. Pat. No. 5,653,048 incorporated herein by reference.

In some applications, the shrouds 10 can be large and heavy. In these circumstances, an eye 116 is formed on top of the shroud to facilitate the attachment of a hook or the like by way of a crane. During digging, however, the eye will wear out and not be available for lifting the shroud from the lip for replacement. To enable the attachment of a hook, opening 104 is also preferably formed with an extension 104*a* rearward of lock 16.

In the preferred construction, a depression 130 is formed on the top converging wall 70 to act as a wear indicator. More specifically, when the depression is no longer visible, the user knows that it is time to replace the shroud. The depression is sized and positioned so that replacement occurs when most of the working portion 66 has worn away but before cavity 90 is exposed through the working portion thus exposing base 14 to the highly abrasive material.

The above discussion concerns the preferred embodiments of the present invention. Various other embodiments as well as many changes may be made without departing from the spirit and broader aspects of the invention as defined in the claims.

The invention claimed is:

1. A wear member for protecting a digging edge of an excavating bucket, the wear member comprising:

a front portion adapted to contact abrasive materials during digging by the excavating bucket;

a pair of rearwardly extending legs that define a cavity therebetween to receive the digging edge, the cavity being open at a rear end to receive the digging edge and having a front end that dips downward relative to the rear end and is closed by a rearward facing abutting surface defining a front abutting surface, the front end being defined by an upper surface, a lower surface, and the front abutting surface that extends between the upper and lower surfaces, the upper surface, the lower surface and the front abutting surface each overlying and bearing against corresponding walls of the digging edge to resist loads applied during digging, the upper and lower surfaces being inclined in the same general direction relative to a central plane of the digging edge, the lower surface generally facing toward the front abutting surface, and the cavity being laterally open rearward of the front end to accommodate a wider lateral extension of the digging edge beyond the legs; and an opening for receiving a lock to hold the wear member to the digging edge.

2. A wear member in accordance with claim 1 wherein the upper and lower surfaces are generally parallel to each other.

3. A wear member in accordance with claim 1 in which a support projects into the cavity to fit within a complementary recess defined in the digging edge, wherein the support is partially defined by one of the upper and lower inclined surfaces.

4. A wear member in accordance with claim 3 wherein the support is a ridge that extends laterally across the cavity.

5. A wear member in accordance with claim 1 in which the opening for the lock includes a front wall and a rear wall, wherein the rear wall extends farther into the cavity than the front wall.

6. A wear member in accordance with claim 1 wherein the abutting surface is concave and curved about two perpendicular axes.

7. A wear member in accordance with claim 6 wherein the abutting surface has a center and the lower surface is at an acute angle to a plane extending tangential to the center of the abutting surface.

8. A wear member in accordance with claim 1 which is a shroud.

9. A wear member in accordance with claim 1 wherein the cavity is asymmetric in vertical cross section.

10. A wear member in accordance with claim 1 wherein the opening for receiving the lock is provided in only one of the legs.

11. A wear member for protecting a digging edge of an excavating bucket, the wear member comprising:

a front portion adapted to contact abrasive materials during digging by the excavating bucket;

a pair of legs extending rearward from the front portion;

a cavity defined between the legs to receive the digging edge, the cavity being open at a rear end to receive the digging edge and having a front end that dips downward relative to the rear end and is closed by a front abutting surface, the front end being defined by the front abutting surface, a top face and a bottom face, the cavity being laterally open rearward of the front end to accommodate a lateral extension of the digging edge beyond the legs, the front abutting surface, the top face and the bottom face overlying and bearing against corresponding walls of the digging edge to resist loads applied during digging, the top and bottom faces each being inclined downward in a forward direction relative to a central plane of the digging edge, and the front abutting surface facing rearward and being generally perpendicular to the central plane of the digging edge; and an opening to receive a lock to hold the wear member to the digging edge.

12. A wear member in accordance with claim 11 wherein the opening is formed in only one leg.

13. A wear member in accordance with claim 11 wherein the front end of the cavity is further defined by side faces to resist side loading applied to the wear member.

14. A wear member in accordance with claim 11 wherein the cavity is asymmetric in vertical cross section.

15. A wear member in accordance with claim 14 wherein the opening includes a front wall and a rear wall, and the rear wall is longer in a direction toward the cavity than the front wall for increased engagement with the lock.

16. A wear member for protecting a digging edge of an excavating bucket, the wear member comprising:

a front portion adapted to contact abrasive materials during digging by the excavating bucket;

a cavity for receiving the digging edge, the cavity being open at a rear end to receive the digging edge and having a front end that dips downward relative to the rear end and is closed by a rearward facing abutting surface defining a front abutting surface, the front end being defined by a top face, a bottom face and the front abutting surface, the top face, the bottom face and the front abutting surface each overlying and bearing against corresponding walls of the digging edge to resist loads applied during digging, the top and bottom faces being generally parallel to each other, and the bottom face being generally at an acute angle to the front abutting surface; and an opening for receiving a lock to hold the wear member to the digging edge.

17. A wear member in accordance with claim 16 wherein the front end of the cavity is further defined by side faces to resist side loading applied to the wear member.

18. A wear member in accordance with claim 16 wherein the front abutting surface is concave and curved about two perpendicular axes.

19. A wear member in accordance with claim 18 wherein the abutting surface has a center and the bottom face is at an acute angle to a plane extending tangential to the center of the abutting surface.

20. A wear member in accordance with claim 16 wherein the opening includes a rear face to contact substantially all of a rear wall of the lock installed between the rear face and a rear wall of the digging edge.

21. A wear member in accordance with claim 16 wherein the cavity is asymmetric in vertical cross section.

* * * * *